US010455310B2

(12) United States Patent
Tsutsui et al.

(10) Patent No.: US 10,455,310 B2
(45) Date of Patent: Oct. 22, 2019

(54) MICROPHONE UNIT

(71) Applicant: HOSIDEN CORPORATION, Yao-shi (JP)

(72) Inventors: Keina Tsutsui, Kuratemachi (JP); Tetsuji Muraoka, Kuratemachi (JP); Hidenori Motonaga, Kuratemachi (JP); Kensuke Nakanishi, Kuratemachi (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 15/896,554

(22) Filed: Feb. 14, 2018

(65) Prior Publication Data

US 2018/0242067 A1 Aug. 23, 2018

(30) Foreign Application Priority Data

Feb. 17, 2017 (JP) ..... 2017-028341

(51) Int. Cl.

| | |
|---|---|
| ***H04R 1/08*** | (2006.01) |
| ***H04R 1/04*** | (2006.01) |
| ***H04R 7/04*** | (2006.01) |
| ***H04R 19/00*** | (2006.01) |
| ***H04R 19/04*** | (2006.01) |

(52) U.S. Cl.

CPC ..... *H04R 1/083* (2013.01); *H04R 1/04* (2013.01); *H04R 7/04* (2013.01); *H04R 19/005* (2013.01); *H04R 19/04* (2013.01); *H04R 2201/003* (2013.01)

(58) Field of Classification Search

CPC ..... H01L 29/84; H01L 21/50; H04R 1/083; H04R 19/04; H04R 2201/003; H04R 19/005; H04R 7/04; H04R 9/08

USPC ..... 257/416; 438/51; 428/138; 156/73.1; 381/174, 176, 369, 355, 361

See application file for complete search history.

(56) References Cited

U.S. PATENT DOCUMENTS 7,843,021 B2 * 11/2010 Zhe ..... B81C 1/00301 257/416

2002/0172382 A1 11/2002 Nakabayashi (Continued)

FOREIGN PATENT DOCUMENTS

| | | |
|---|---|---|
| EP | 2305458 A1 | 4/2011 |
| JP | 2008-199225 A | 8/2008 |
| WO | 2012073513 A1 | 6/2012 |

OTHER PUBLICATIONS

Extended European Search Report for European Patent Application EP 18154193.9 dated Jul. 4, 2018 (9 pages).

*Primary Examiner* — Binh Kien Tieu

(74) *Attorney, Agent, or Firm* — Kratz, Quintos & Hanson, LLP

(57) ABSTRACT

A microphone unit including a substrate, a microphone, a fixing member, and a film. The substrate includes a first face, a second face opposite to the first face, and a through-hole extending from the first face to the second face through the substrate. The microphone is mounted on or fixed onto the second face of the substrate and has a sound hole in communication with the through-hole of the substrate. The fixing member is fixed onto the first face of the substrate such as to be located around the through-hole. The film provides at least one of dustproofness and waterproofness and is fixed onto the fixing member such as to cover the through-hole.

21 Claims, 15 Drawing Sheets

(56) References Cited

U.S. PATENT DOCUMENTS

| | | | | |
|---|---|---|---|---|
| 2008/0232615 | A1* | 9/2008 | Song | H04R 19/005 381/174 |
| 2010/0247857 | A1* | 9/2010 | Sanami | H04M 1/18 428/138 |
| 2011/0317863 | A1* | 12/2011 | Inoda | H04R 19/04 381/369 |
| 2012/0087521 | A1* | 4/2012 | Delaus | B81C 1/00238 381/174 |
| 2013/0069180 | A1* | 3/2013 | Umeda | H04R 19/04 257/416 |
| 2013/0129119 | A1* | 5/2013 | Miyatake | H04R 19/04 381/176 |
| 2014/0072151 | A1* | 3/2014 | Ochs | H04R 23/00 381/174 |
| 2015/0078592 | A1* | 3/2015 | Uchida | H04R 19/04 381/191 |
| 2016/0091378 | A1 | 3/2016 | Tsai | |
| 2017/0374441 | A1* | 12/2017 | Hoekstra | B81C 1/00309 |

* cited by examiner

MICROPHONE UNIT

CROSS-REFERENCE TO RELATED APPLICATIONS

The present application claims priority under 35 U.S.C. § 119 of Japanese Patent Application No. 2017-028341 filed on Feb. 17, 2017, the disclosure of which is expressly incorporated by reference herein in its entirety.

BACKGROUND OF THE INVENTION

Technical Field

The invention relates to microphone units.

Background Art

Japanese Unexamined Patent Application Publication No. 2008-199225 describes a conventional microphone mounting structure. This mounting structure includes a housing of an electronic device, a microphone, a waterproof/dustproof mesh sheet, and first and second tapes being double-sided adhesive tapes of loop shape. The housing includes a wall with a first sound hole. The microphone has a second sound hole. The microphone is bonded to the wall of the housing with the first tape, such that the second sound hole opens toward the wall of the housing and does not overlap the first sound hole. The outer sizes of the second tape and the mesh sheet are smaller than the inner size of the first tape. The mesh sheet is disposed inside the first tape and bonded to the wall of the housing with the second tape.

SUMMARY OF INVENTION

The above mounting structure is manufactured by bonding the first tape to the wall of the housing, bonding the mesh sheet to the wall of the housing with the second tape such that the mesh sheet and the second tape are located inside the first double-sided tape, and then bonding the microphone to the wall of the housing with the first tape. As such, it is difficult to mount the mesh sheet in position.

The invention has been made in the above circumstances to provide a microphone unit with a film that has at least one of dustproofness and waterproofness is easy to mount in place.

A microphone unit of an aspect of the invention includes a substrate, a microphone, a fixing member, and a film. The substrate includes a first face, a second face opposite to the first face, and a through-hole extending from the first face to the second face through the substrate. The microphone is mounted on or fixed onto the second face of the substrate and has a sound hole in communication with the through-hole of the substrate. The fixing member is fixed onto the first face of the substrate such as to be located around the through-hole. The film provides at least one of dustproofness and waterproofness and is fixed onto the fixing member such as to cover the through-hole.

The microphone unit of this aspect is configured such as to facilitate attachment of the film. This is because the fixing member with the film fixed thereto can be fixed to a face (the first face) opposite to the face (second face) of the substrate to mount the microphone.

The fixing member may be generally loop-shaped and may have an inner size that is larger than a size of the through-hole. At least one of the fixing member and the substrate may be provided with a vent to connect an inside of the fixing member to an outside of the fixing member.

In the microphone unit of this aspect, the inside of the fixing member communicates with the outside of the fixing member through the vent to allow ventilation. Accordingly, changes in the external environment (temperature, humidity and/or atmospheric pressure) are not likely to result in a difference between the external environment and the environment (temperature, humidity and/or atmospheric pressure) of the space defined by the fixing member, the through-hole of the substrate, and the sound hole of the microphone. Such reduced difference between these two environments in turn reduces adverse effect on the acoustic performance of the microphone.

The substrate may further include a first electrode on the first face. The fixing member may include a metal plate fixed to the film and bonded to the first electrode of the substrate with a bonding material. In the microphone unit of this aspect, the metal plate of the fixing member is bonded to the first electrode of the substrate by the bonding material. This arrangement facilitates fixing the metal plate to the first face of the substrate.

Alternatively, the fixing member may be an adhesive portion to bond the film to the substrate. The adhesive portion may be, for example, a double-sided adhesive tape or an adhesive layer.

The film may include a first portion fixed to the fixing member, a second portion located inside the first portion, and a third portion located between the first portion and the second portion.

At least one of the second portion and the third portion may include a slack portion. The slack portion may have a cross section of, for example, arc-shape, V-shape, U-shape, wavelike shape, or any other suitable shape. Alternatively, at least one of the second portion and the third portion may be smaller in thickness than the first portion. Still alternatively, at least one of the second portion and the third portion may be smaller in rigidity than the first portion. In the microphone unit of any of these three aspects, at least one of the second portion and the third portion warps. This reduces a difference between the external environment and the environment (temperature, humidity and/or atmospheric pressure) of the space defined by the fixing member, the through-hole of the substrate, and the sound hole of the microphone. Such reduced difference between these two environments in turn reduces adverse effect on the acoustic performance of the microphone.

The substrate may further include at least one resist layer. The at least one resist layer may be located at least one of locations (1) and (2): (1) on the first face of the substrate and between the first face of the substrate and the fixing member, and (2) on the second face of the substrate and between the second face of the substrate and the microphone. The vent may be provided in the resist layer.

The substrate may further include second electrodes on the second face. The microphone may be connected to the second electrodes.

The film of any of the above aspect may further provide heat resistance.

DESCRIPTION OF EMBODIMENTS

Figure 1A:
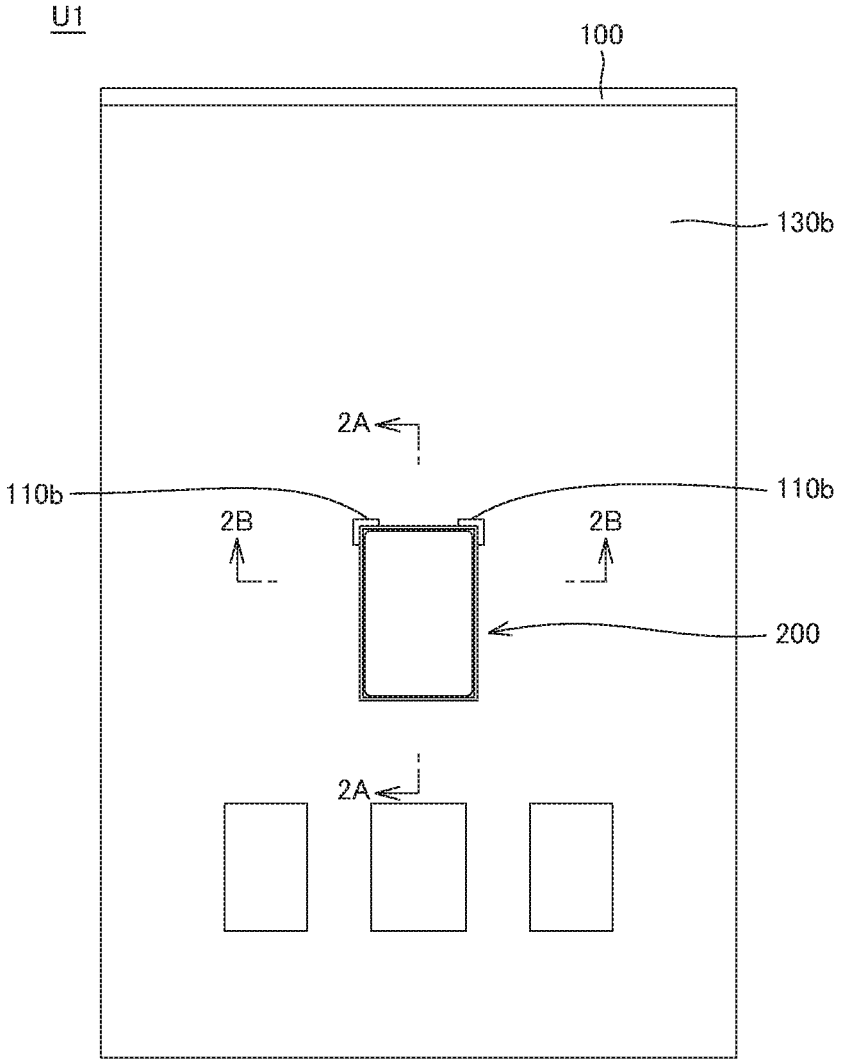
FIG. 1A is a schematic front top side perspective view of a microphone unit according to a first embodiment of the invention.
Figure 1B:
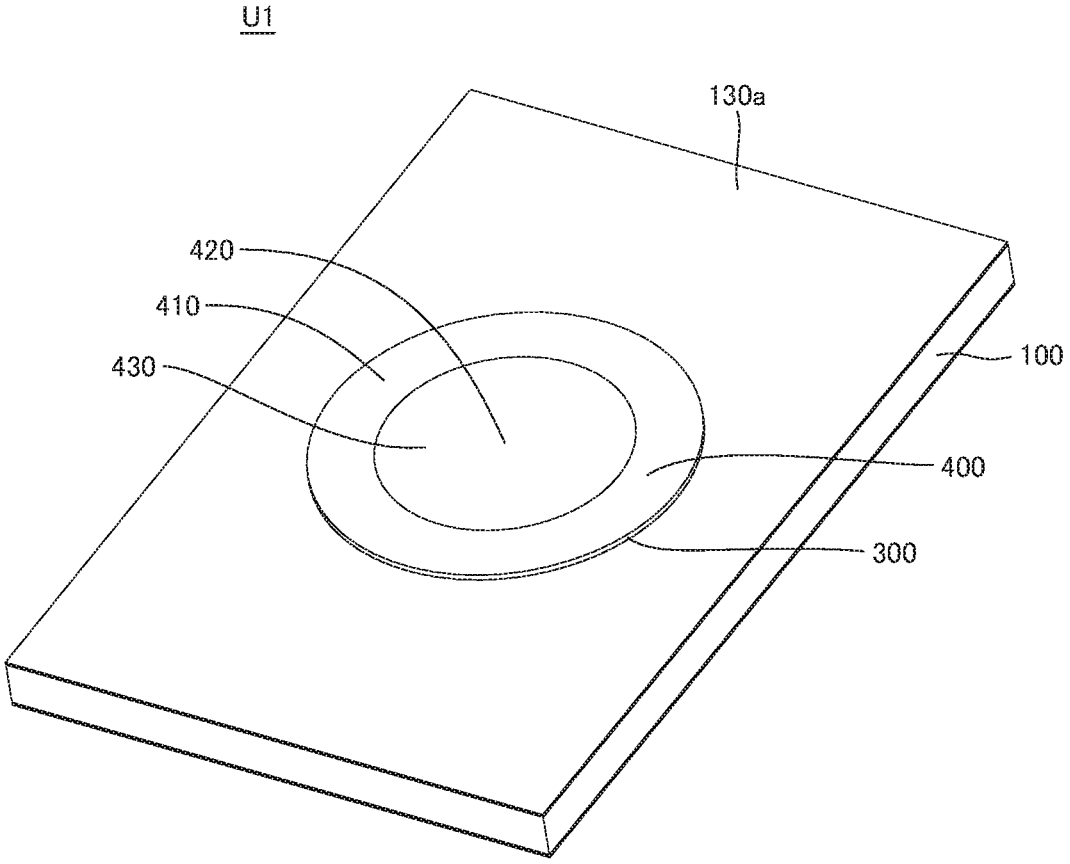
FIG. 1B is a schematic back, bottom, left side perspective view of the microphone unit.
Figure 1C:
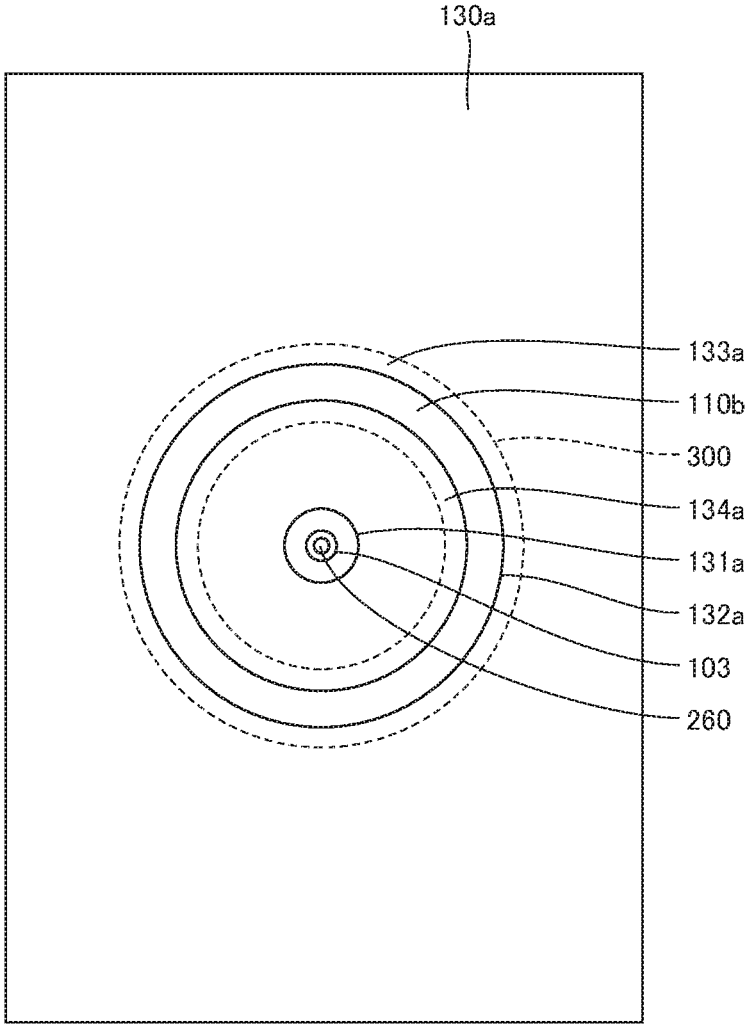
FIG. 1C is a schematic bottom view of the microphone unit, with the film of the microphone unit removed, and with a fixing member shown as transparent.

Various embodiments of the invention will be hereinafter described.

First Embodiment

The following describes a microphone unit U1 (which may be simply referred to as the unit U1) according to a plurality of embodiments including the first embodiment of the invention, with reference to FIGS. 1A to 3B. FIGS. 1A to 3B show the unit U1 according to the first embodiment. The unit U1 includes a substrate 100 and a microphone 200. It should be noted that the Z-Z' direction indicated in FIGS. 2A to 2B is the thickness direction of the substrate 100. In the Z-Z' direction, the Z direction is one side of the thickness direction, and the Z' direction is the other side of the thickness direction.

The substrate 100 includes a first face 101, a second face 102, and a through-hole 103. The first face 101 is the Z-direction-side face of the substrate 100, and the second face 102 is the Z'-direction-side face of the substrate 100, i.e. the face opposite to the first face 101. The through-hole 103 extends from the first face 101 to the second face 102 through the substrate 100.

The microphone 200 may be a capacitor microphone, for example. The microphone 200 includes a diaphragm 210, a frame 220 to hold the diaphragm 210, a substrate 230, a cup-shaped capsule 240, an integrated circuit (IC) 250, an electret layer or a back plate (not shown), and at least one sound hole 260.

Figure 2A:
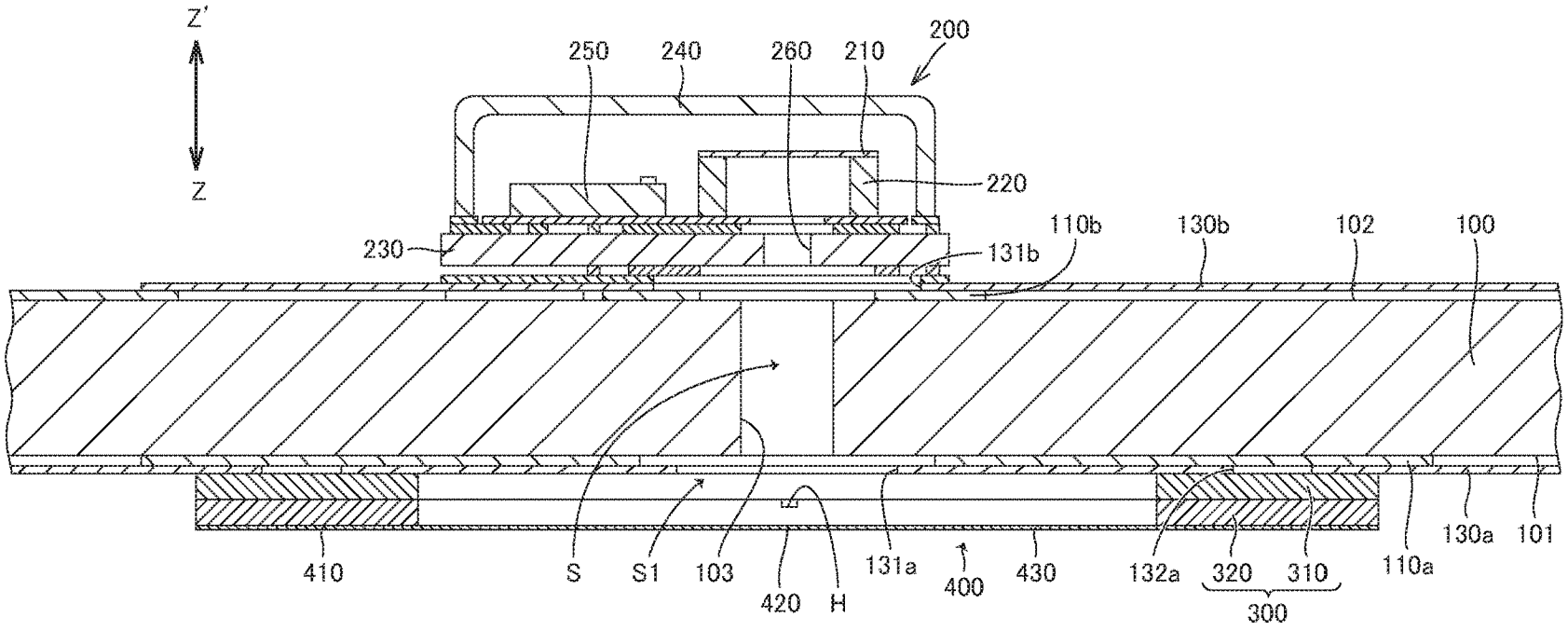
FIG. 2A is a cross-sectional view of the microphone unit, taken along a line 2A-2A in FIG. 1A.
Figure 2B:
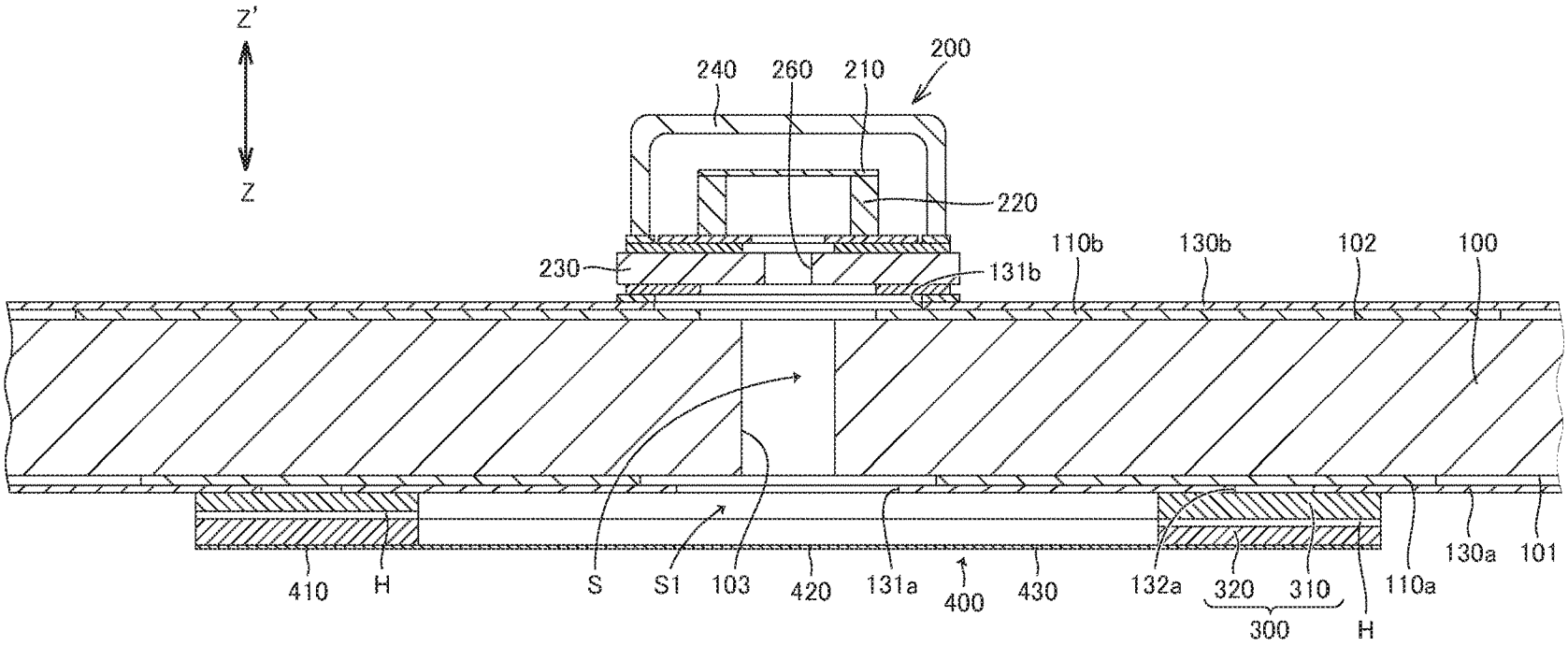
FIG. 2B is a cross-sectional view of the microphone unit, taken along a line 2B-2B in FIG. 1A.
Figure 3A:
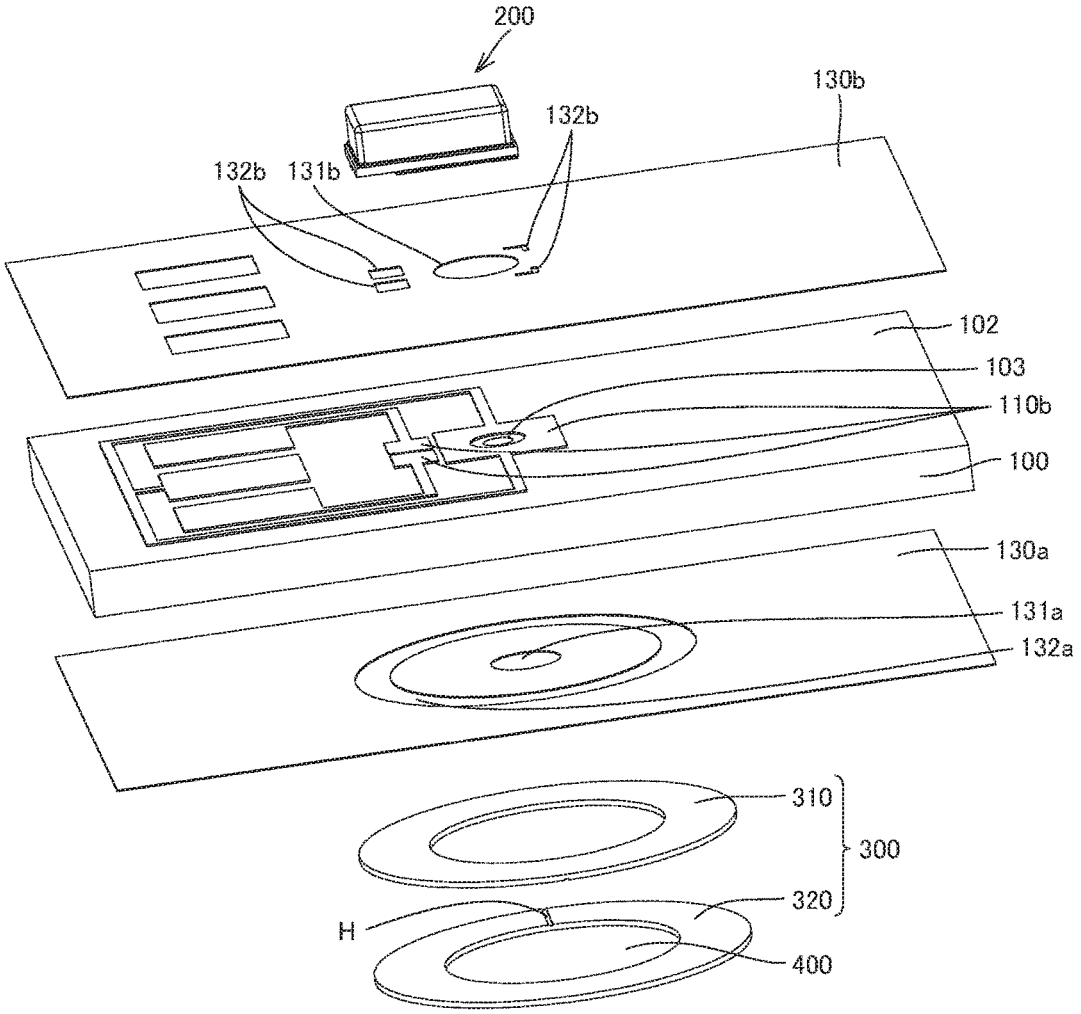
FIG. 3A is a schematic exploded front, top, right side perspective view of the microphone unit.
Figure 3B:
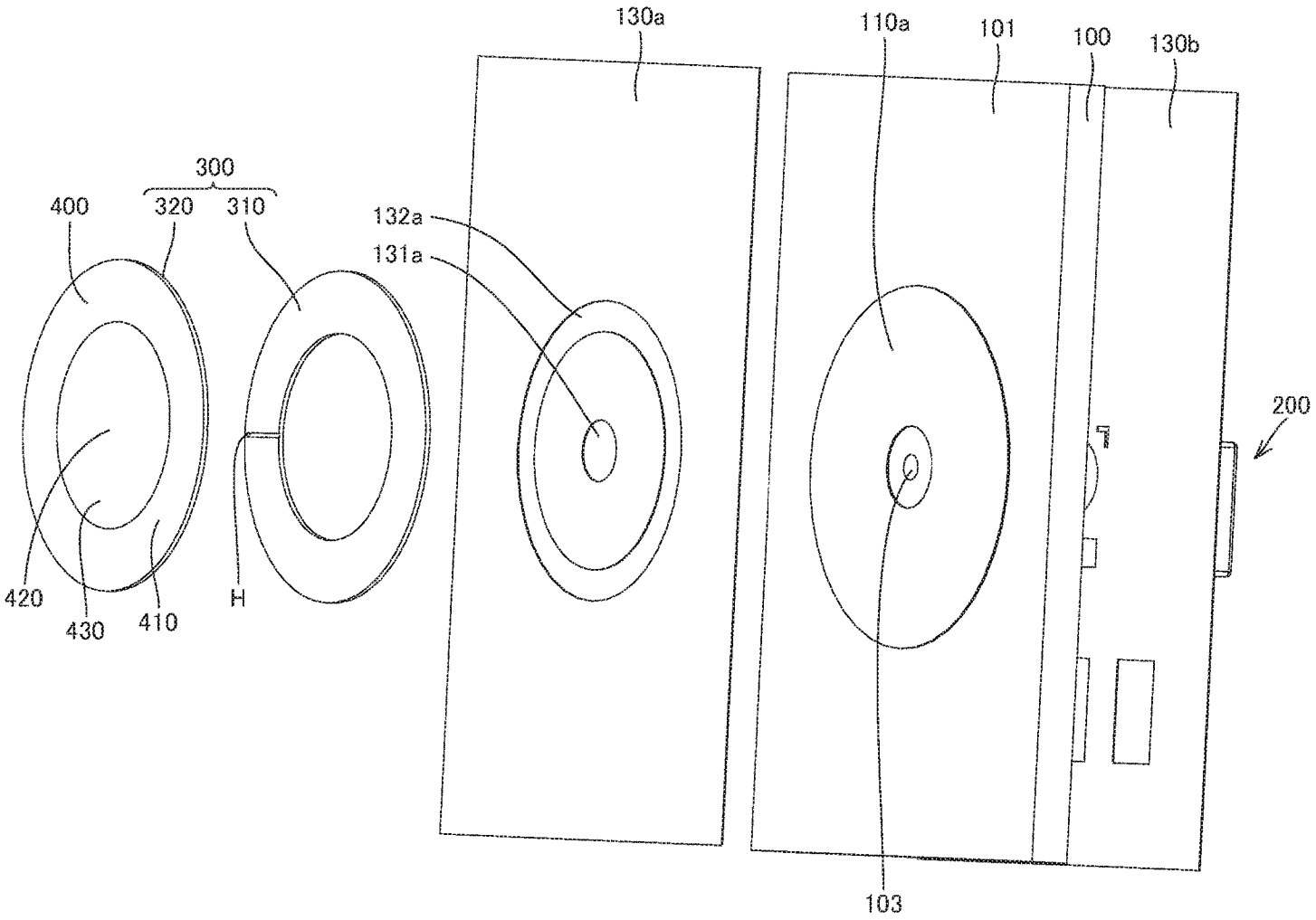
FIG. 3B is a schematic exploded back, bottom, left side perspective view of the microphone unit.

The capsule 240 has a cup shape with an open bottom and a ceiling. This open bottom of the capsule 240 will be referred to as an open portion. The capsule 240 may be fixed onto the substrate 230 such that the open portion of the capsule 240 is closed and blocked with the substrate 230 as shown in FIGS. 2A and 2B. An alternative configuration (not shown) is such that the capsule 240 houses the substrate 230 and the open portion of the capsule 240 is closed and blocked with the substrate 230. The IC 250 is mounted on the substrate 230 and housed in the capsule 240.

The electret layer or the back plate is provided a) on a portion of the inner face (Z'-direction-side face) of the substrate 230, the portion being located inside the capsule 240; b) on the inner face (Z-direction-side face) of the ceiling of the capsule 240; or c) on a support plate (not shown) that is supported inside the capsule 240. The diaphragm 210 and the frame 220 are fixed to or held on at least one of the capsule 240 and the substrate 230 such that the diaphragm 210 faces the electret layer or the back plate with a space therebetween inside the capsule 240. If the diaphragm 210 is provided to face the back plate with a space therebetween, the electret layer may also be provided on the diaphragm 210. The at least one sound hole 260 is a through-hole in the substrate 230 or the capsule 240 and open toward at least part of the diaphragm 210. The embodiment of FIGS. 1A to 3B is provided with a single sound hole 260 in the substrate 230.

The microphone 200 of any of the above aspects is mounted on and/or fixed onto the second face 102 of the substrate 100 such that the at least one sound hole 260 communicates with the through-hole 103 of the substrate 100. If the microphone 200 is mounted on the second face 102 of the substrate 100, the microphone 200 may preferably be electrically connected to the substrate 100. Specifically, it is preferable that the substrate 100 further include a plurality of second electrodes 110*b* (second electrodes) on the second face 102, and that the electrodes 110*b* be bonded to corresponding electrodes on the substrate 230 of the microphone 200 with an electrically conductive bonding material, such as solder or silver paste. If the microphone 200 is fixed onto the second face 102 of the substrate 100, the fixation may preferably be such that the microphone 200 is bonded onto the second face 102 of the substrate 100 with a bonding material of different kind, such as insulating material (e.g. a cushioning material) or adhesive. In this case, the microphone 200 may preferably be electrically connected to the substrate 100 with connecting means, such as wires or pins. The microphone 200, mounted on or fixed to the substrate 100, covers the at least one through-hole 103 of the substrate 100 from the Z'-direction side. The microphone 200 is connectable to the outside via the substrate 100.

The unit U1 further includes a fixing member 300 and a film 400. The fixing member 300 is generally loop-shaped and has an inner size that is larger in planar direction than the size of the through-hole 103 of the substrate 100. The fixing member 300 is fixed onto the first face 101 of the substrate 100 such as to be located around the through-hole 103. In other words, the through-hole 103 of the substrate 100 is arranged inside the fixing member 300 as fixed onto the first face 101 of the substrate 100. The planar direction is a direction extending along the first face 101 of the substrate 100 and is orthogonal to the Z-Z' direction.

The film 400 provides at least one of dustproofness and waterproofness. The film 400 may further provide air impermeability (i.e., the fill 400 has no holes that allow airflow therethrough). The film 400 is fixed to the fixing member 300 such that the film 400 covers the through-hole 103 of the substrate 100 from the Z-direction side. The film 400 as fixed to the fixing member 300 is flat. The film 400, the fixing member 300, and the first face 101 of the substrate 100 define a space S1, which communicates with the through-hole 103 of the substrate 100. This space S1 will be referred to as "the inside of the fixing member 300" (space located inside relative to the fixing member 300 in the microphone unit).

The film 400 includes a first portion 410, a second portion 420, and a third portion 430. The first portion 410 is fixed to the fixing member 300. The second portion 420 is located inside the first portion 410 of the film 400'. The third portion 430 is located between the first portion 410 and the second portion 420. For example, the first portion 410 may be the, generally loop-shaped, peripheral (outermost) portion of the film 400 and may be, the second portion 420 may be a central (innermost) portion of the film 400, and the third portion 430 may be a, generally loop-shaped, intermediate portion of the film 400 between the first portion 410 and the second portion 420.

The fixing member 300 may include a metal plate 310 of generally loop shape and an adhesive portion 320 of generally loop shape. The adhesive portion 320 may be, for example, a double-sided adhesive tape or an adhesive layer. The adhesive portion 320 serves to bond the metal plate 310 to the first portion 410 of the film 400 such that the film 400 covers the through-hole 103 of the substrate 100. The substrate 100 includes a first electrode 110*a* (first electrode) on the first face 101, and the metal plate 310 is bonded to the electrode 110*a* with a bonding material (e.g., solder or silver paste). In this case, the film 400 may preferably further provides such heat resistance as to withstand the heat (e.g., 250° C. to 260° C.) during the bonding.

Alternatively, the fixing member 300 may include only the generally loop-shaped metal plate 310. The metal plate 310 is thermocompression-bonded to the first portion 410 of the film 400. The metal plate 310 is bonded to the electrode 110*a* on the first face 101 of the substrate 100 with a bonding material (e.g., solder or silver paste). In this case, the film 400 preferably further has heat resistance capable of withstanding heat (e.g., 250 to 260° C.) during the thermocompression bonding and the heat during the bonding.

The substrate 100 may further include a resist layer 130*a*. The resist layer 130*a* is arranged on the first face 101 of the substrate 100. A non-limiting example of the resist layer 130*a* is solder resist covering the first face 101 of the substrate 100. The resist layer 130*a* may be sandwiched directly between the first face 101 of the substrate 100 and the fixing member 300. Alternatively, the resist layer 130*a* may be sandwiched between the first face 101 of the substrate 100 and the fixing member 300 together with another member (e.g., resist or other insulator). The resist layer 130*a* has an opening 131*a* in communication with the through-hole 103 of the substrate 100. The resist layer 130*a* may further has another opening 132*a* of generally loop shape located around the opening 131*a*, an outer peripheral portion 133*a* of generally loop shape surrounding the opening 132*a*, and an inner peripheral portion 134*a* of generally loop shape surrounded by the opening 132*a*. The opening 132*a* is sized such that its outer size is smaller than the outer size of the fixing member 300, and/or its inner size is larger than the inner size of the loop-shaped fixing member 300 (see FIGS. 1C to 2B). As such, the resist layer 130*a*, particularly the outer peripheral portion 133*a* surrounding the opening 132*a* and/or the inner peripheral portion 134*a* surrounded by the opening 132*a*, is held by and between the fixing member 300 and the first face 101 of the substrate 100. If the substrate 100 is provided with the electrode 110*a* on the first face 101, the electrode 110*a* may preferably be exposed through the opening 132*a*. In this case, the exposed portion of the electrode 110*a* is bonded to the metal plate 310 of the fixing member 300 in a manner as described above.

The substrate 100 may further include another resist layer 130*b*. The resist layer 130*b* is arranged on the second face 102 of the substrate 100. A non-limiting example of the resist layer 130*b* is solder resist covering the second face 102 of the substrate 100. The resist layer 130*b* may be sandwiched directly between the second face 102 of the substrate 100 and the microphone 200. Alternatively, the resist layer 130*b* may be sandwiched between the second face 102 of the substrate 100 and the microphone 200 together with another member (e.g., resist or other insulator). The resist layer 130*b* includes an opening 131*b* in communication with the through-hole 103 of the substrate 100 and the at least one sound hole 260 of the microphone 200. The resist layer 130*b* may further has additional openings 132*b* through which the electrodes 110*b* are exposed. The resist layer 130*b* and/or the resist layer 130*a* may be omitted.

The through-hole 103 of the substrate 100 is covered from the Z-direction side by the fixing member 300 and the film 400. The through-hole 103 of the substrate 100 is covered from the Z'-direction side by the microphone 200 as described above. As such, an enclosed space (hereinafter referred to as an enclosed space S) is provided as shown in FIGS. 2A and 2B, defined by the following four spaces: a) the space S1, b) the space within the through-hole 103, c) the space within the at least one sound hole 260 of the microphone 200, wherein space c) communicates with space b), and d) the space inside the microphone 200, wherein space d) communicates with the at least one sound hole 260. In other words, the enclosed space S includes spaces a) to d). The enclosed space S may form an airtight seal if the film 400 is air impermeable, but the enclosed space S may not be airtight.

There may be a gap between the second face 102 of the substrate 100 and the microphone 200. If any, such gap may be closely sealed with plastic material or other sealing material. Also, there may be a gap between the first face 101 of the substrate 100 and the fixing member 300. If any, such gap may be closely sealed by the bonding means as described above, by thermocompression bonding, or with plastic material or other sealing material.

At least one of the fixing member 300 and the substrate 100 may include at least one vent H to connect the space S1 to the outside of the fixing member 300. By "the outside of the fixing member 300" is meant the space located outside relative to the fixing member 300. The at least one vent H may have one of the following configurations 1) to 6):

1) The or each vent H is a through-hole, a groove (see FIGS. 2B and 3B), or a cutout formed in the metal plate 310 of the fixing member 300 and extending in the planar direction.

2) The or each vent H is a through-hole or a groove (see FIGS. 2B and 3A) formed in the adhesive portion 320 of the fixing member 300 and extending in the planar direction. For example, if the adhesive portion 320 is a double-sided tape, the or each vent H is a through-hole formed in an intermediate sheet of the double-sided tape or a groove formed in an adhesive layer of the double-sided tape.

3) The or each vent H is a groove formed in the electrode 110*a* of the substrate 100 and extending in the planar direction.

4) If the substrate 100 includes the resist layer 130*a* and/or the resist layer 130*b*, the or each vent H is a through-hole or a groove formed in the resist layer 130*a* or the resist layer 130*b* and extending in the planar direction.

5) If an interposing member is provided between the substrate 100 and the fixing member 300 and/or an interposing member is provided between the substrate 100 and the microphone 200, the or each vent H is a through-hole or a groove formed in the associated interposing member and extending in the planar direction.

6) If the substrate 100 is a multilayer board, the or each vent H is a via hole in an associated layer of the substrate 100. The via holes of neighboring layers communicate with each other.

If a plurality of vents H are provided, all the vents H may have the same one of the configurations 1) to 6) or have different configurations. In the embodiment of FIGS. 1A to 3B, two vents H are provided, one of which has configuration 1) and the other has configuration 2). The unit U1 may be provided without any vents H.

If the unit U1 is provided with no vent H, changes in the external environment (temperature, humidity and/or atmospheric pressure) result in a difference between the external environment and the environment (temperature, humidity, and/or an internal pressure) in the enclosed space S. This difference may adversely affect the acoustic performance of the microphone 200, e.g. affect vibrations of the diaphragm 210. In contrast, if the unit U1 is provided with one or more vents H, changes in external environment are not likely to result in a difference between the external environment and the environment in the enclosed space S. This is because the at least one vent H connects the space S1 (the inside of the fixing member 300) of the enclosed space S to the outside of the fixing member 300, so that in case of changes in external environment of the unit U1, the temperature, the humidity and/or the internal pressure in the enclosed space S will be automatically adjusted through the vent H. Therefore, changes in the external environment of the unit U1 are less likely to affect the acoustic performance of the microphone 200, e.g., less likely to affect vibrations of the diaphragm 210.

The following describes a method for manufacturing the unit U1. First, the substrate 100 and the microphone 200 are prepared. The substrate 100 to be prepared may or may not have the resist layer 130*a* and/or the resist layer 130*b*. The microphone 200 is bonded to the electrodes 110*b* on the second face 102 of the substrate 100 with an electrically conductive bonding material using a flow or reflow method, so that the microphone 200 is electrically connected with the electrodes 110*b* of the substrate 100. Alternatively, the microphone 200 may be fixed to the second face 102 of the substrate 100 with a non-conductive bonding material and electrically connected to the substrate 100 with connecting means. In either case, the microphone 200 is disposed such that the at least one sound hole 260 thereof is brought into communication with the through-hole 103 of the substrate 100, and that the microphone 200 covers the through-hole 103 of the substrate 100 from the Z'-direction side.

The fixing member 300 and the film 400 are also prepared. If the fixing member 300 has the at least one vent H, the at least one vent H may preferably be formed in the fixing member 300 in advance. The first portion 410 of the film 400 is fixed to the fixing member 300. For example, the first portion 410 of the film 400 may be bonded to the metal plate 310 of the fixing member 300 with the adhesive portion 320 or thermocompression-bonded to the metal plate 310 of the fixing member 300.

Thereafter, the fixing member 300 is fixed onto a portion of the first face 101 of the substrate 100, the portion being located around the through-hole 103. Specifically, the metal plate 310 of the fixing member 300 is bonded to the electrode 110*a* on the first face 101 of the substrate 100 with the bonding material using a flow or reflow method, and the film 400 covers the through-hole 103 of the substrate 100 from the Z-direction side. The space S1 is thus defined by the film 400, the fixing member 300, and the portion around the through-hole 103 of the first face 101 of the substrate 100.

The above unit U1 provides at least the following technical features and effects. First, the unit U1 is configured such as to allow easy attachment of the film 400 because of the following configurations. The microphone 200 is mounted or fixed onto the second face 102 (mounting face) of the substrate 100. Consequently, the fixing member 300 with the film 400 can be fixed to the first face 101 of the substrate 100, i.e. on the opposite side from the mounting face. Moreover, if the fixing member 300 includes the metal plate 310, the metal plate 310 can be bonded with the bonding material to the electrode 110*a* on the first face 101 of the substrate 100, making it easier to fix the fixing member 300 with the film 400 to the first face 101 of the substrate 100. If a reflow method is used to bond the metal plate 310 with a bonding material to the electrode 110*a* of the first face 101 of the substrate 100, the bonding process can be automated, making it still easier to attach the film 400.

Secondly, if at least one of the fixing member 300 and the substrate 100 includes the at least one vent H, changes in external environment of the unit U1 as described above are unlikely to affect the acoustic performance of the microphone 200.

Second Embodiment

Figure 4:
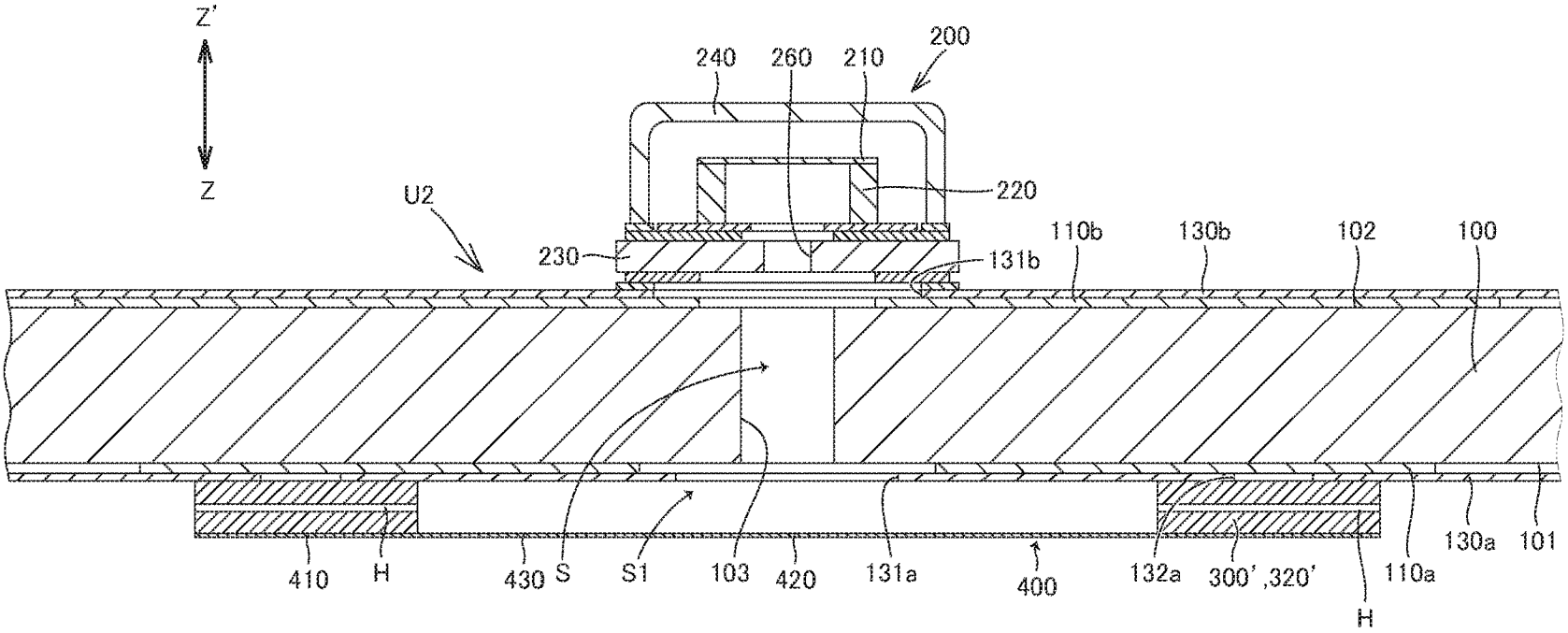
FIG. 4 is a schematic partial cross-sectional view, corresponding to FIG. 2B, of a microphone unit according to a second embodiment of the invention.
Figure 5:
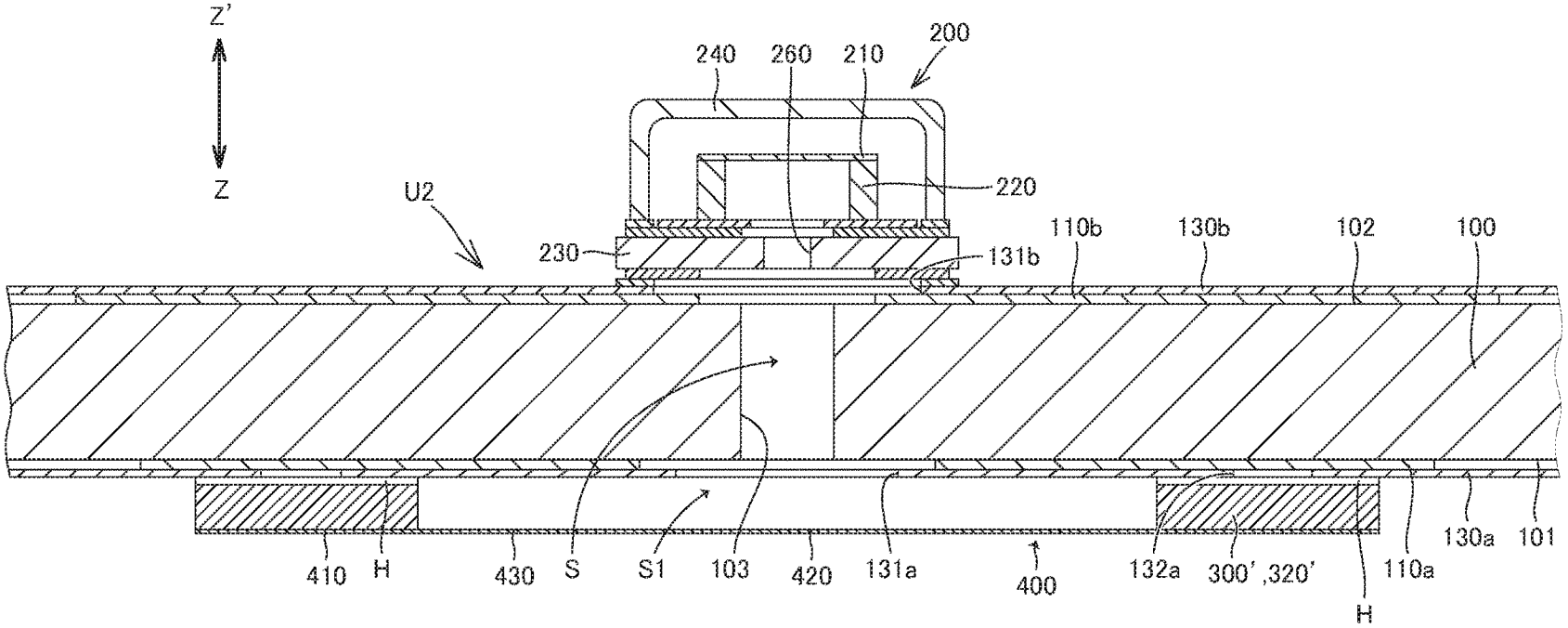
FIG. 5 is a schematic partial cross-sectional view, corresponding to FIG. 2B, of a variant of the microphone unit of the second embodiment.

The following describes a microphone unit U2 (which may be simply referred to as the unit U2) according to a plurality of embodiments including the second embodiment of the invention, with reference to FIGS. 4 and 5. FIG. 4 illustrates the unit U2 of the second embodiment. FIG. 5 illustrates a variant of the unit U2 of the second embodiment.

The unit U2 has the same configuration as a unit U1, except that the unit U2 includes a fixing member 300' of different configuration from that of the fixing member 300 of the unit U1. Accordingly, only the differences will be described, and those features of the unit U2 which generally correspond with those of the unit U1 will not be described in detail.

The fixing member 300' is constituted by an adhesive portion 320' only. The adhesive portion may be, for example, a double-sided adhesive tape or an adhesive layer. The adhesive portion 320' has an inner size that is larger than the size of the through-hole 103 of the substrate 100. The adhesive portion 320' includes a first face and a second face opposite to the first face. The adhesive portion 320' serves to fix the first portion 410 of the film 400 to the first face 101 of the substrate 100 such that the first portion 410 is located around the through-hole 103 on the first face 101 and the film 400 covers the through-hole 103 of the substrate 100. More specifically, the first face of the adhesive portion 320' adheres to a portion around the through-hole 103 of the first face 101 of the substrate 100. The second face of the adhesive portion 320' adheres to the first portion 410 of the film 400. If used with such fixing member 300', the film 400 may not provide heat resistance.

The unit U2 has a space S1 and an enclosed space S defined as follows. The space S1 is defined by the film 400, the fixing member 300', and the first face 101 of the substrate 100. The enclosed space S may preferably be constituted by the following four spaces: a) the space S1, b) the space within the through-hole 103, c) the space within the at least one sound hole 260 of the microphone 200, wherein space c) communicates with space b), and d) the space inside the microphone 200, wherein space d) communicates with the at least one sound hole 260.

At least one of the fixing member 300' and the substrate 100 may include at least one vent H to connect the space S1 to the outside of the fixing member 300'. The at least one vent H may have one of the following configurations 1) to 5):

1) The or each vent H is a through-hole (see FIG. 4) or a groove (see FIG. 5) formed in the adhesive portion 320' of the fixing member 300' and extending in the planar direction. For example, if the adhesive portion 320' is a double-sided tape, the or each vent H is a through-hole formed in the intermediate sheet of the double-sided tape or a groove formed in an adhesive layer of the double-sided tape. In either case, the first face 101 of the substrate 100 may not be provided with any electrodes 110*a*.

2) The or each vent H is a groove formed in the electrode 110*a* of the substrate 100 and extending in the planar direction.

3) If the substrate 100 includes the resist layer 130*a* and/or the resist layer 130*b*, the or each vent H is a through-hole or a groove formed in the resist layer 130*a* or the resist layer 130*b* and extending in the planar direction.

4) If an interposing member is provided between the substrate 100 and the fixing member 300' and/or an interposing member is provided between the substrate 100 and the microphone 200, the or each vent H is a through-hole or a groove formed in the associated interposing member and extending in the planar direction.

5) If the substrate 100 is a multilayer board, the or each vent H is a via hole in an associated layer of the substrate 100. The via holes of neighboring layers communicate with each other. Also in this case, the first face 101 of the substrate 100 may not be provided with any electrodes 110*a*.

If a plurality of vents H are provided, all the vents H may have the same one of the configurations 1) to 5) or have different configurations.

The at least one vent H of the unit U2 functions in a similar manner to the at least one vent H of the unit U1. The unit U2 may also be provided without any vents H.

The unit U2 can be manufactured by a similar method to that for manufacturing the unit U1, except the following steps which will be described in detail. In the step of fixing the first portion 410 of the film 400 to the fixing member 300', the first portion 410 of the film 400 is bonded to the adhesive portion 320' of the fixing member 300'. Thereafter, in the step of fixing the fixing member 300' to the portion around the through-hole 103 of the substrate 100, the adhesive portion 320' of the fixing member 300' is bonded to the portion around the through-hole 103 of the first face 101 of the substrate 100. As a result, the film 400 covers the through-hole 103 of the substrate 100. The space S1 is thus defined by the film 400, the fixing member 300', and the portion around the through-hole 103 of the first face 101 of the substrate 100.

If the fixing member 300' has the at least one vent H, the at least one vent H may preferably be formed in the fixing member 300 in advance.

The unit U2 described above provides similar technical features and effects as the first and second technical features of the unit U1.

Third Embodiment

Figure 6A:
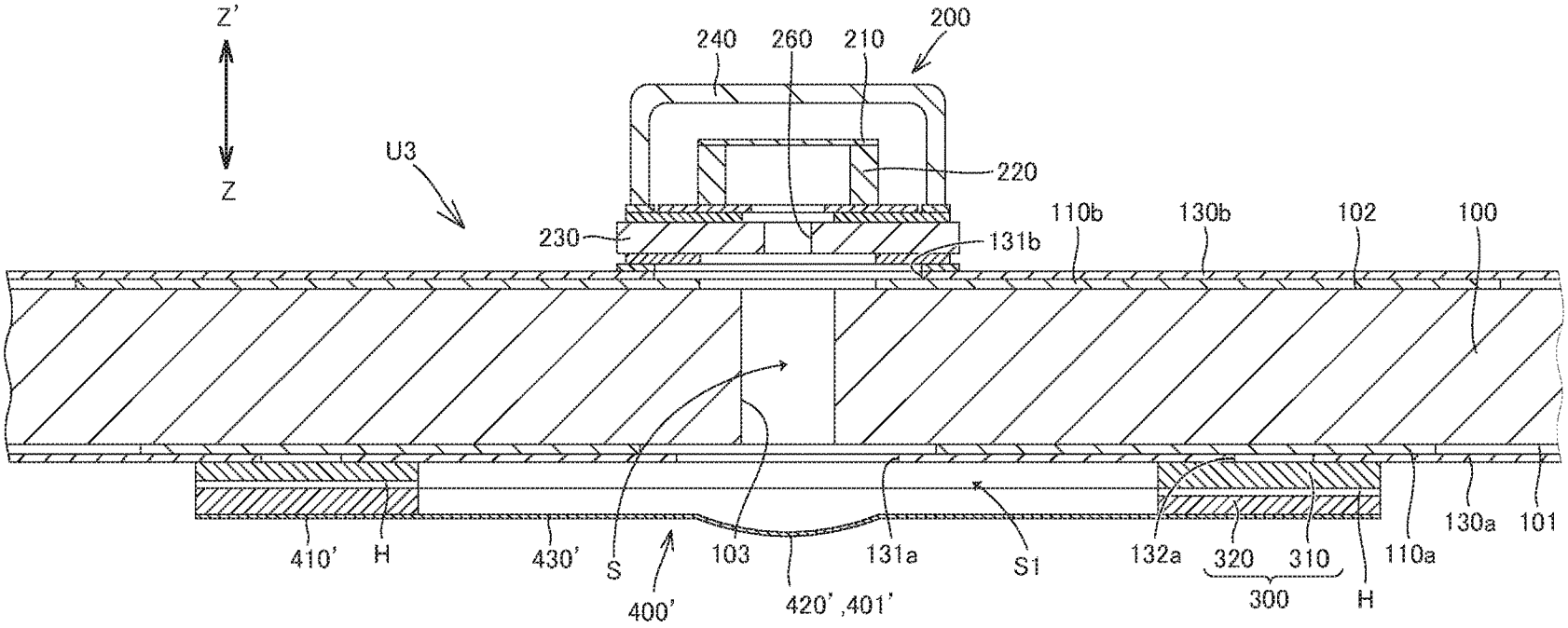
FIG. 6A is a schematic cross-sectional view, corresponding to FIG. 2B, of a microphone unit according to a third embodiment of the invention.

The following describes a microphone unit U3 (which may be simply referred to as the unit U3) according to a plurality of embodiments including the third embodiment of the invention, with reference to FIGS. 6A to 6F. FIG. 6A illustrates the unit U3 of the third embodiment. FIGS. 6B, 6C, 6D, 6E, and 6F respectively illustrates a first, second, third, fourth, and fifth variant of a film 400' of the unit U3 of the third embodiment.

The unit U3 has the same configuration as the unit U1 or U2, except that the film 400' of the unit U3 has a different configuration from that of the film 400 of the unit U1 or U2. Accordingly, only the differences will be described, and those features of the unit U3 which generally correspond with those of the unit U1 or U2 will not be described in detail.

The film 400' includes a first portion 410', a second portion 420', and a third portion 430'. The first portion 410' is fixed to the fixing member 300 (see FIGS. 6A to 6F) or 300' (see FIGS. 4 and 5). The second portion 420' is located inside the first portion 410' of the film 400'. The third portion 430' is located between the first portion 410' and the second portion 420' of the film 400'. For example, the first portion 410' may be may be the, generally loop-shaped, peripheral (outermost) portion of the film 400', the second portion 420' may be a central (innermost) portion of the film 400', and third portion 430' is may be a, generally loop-shaped, intermediate portion of the film 400' between the first portion 410' and the second portion 420'.

Figure 6B:
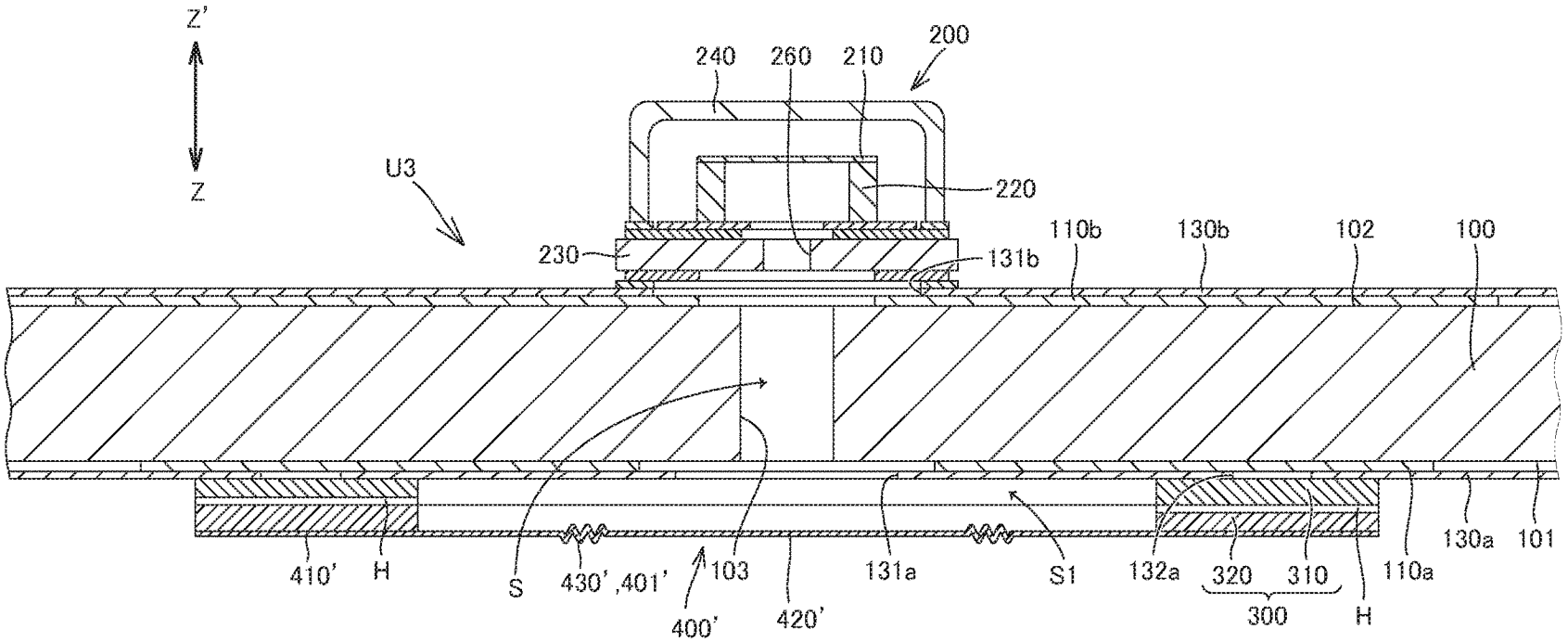
FIG. 6B is a schematic cross-sectional view of a first variant of the film of the microphone unit of the third embodiment.
Figure 6C:
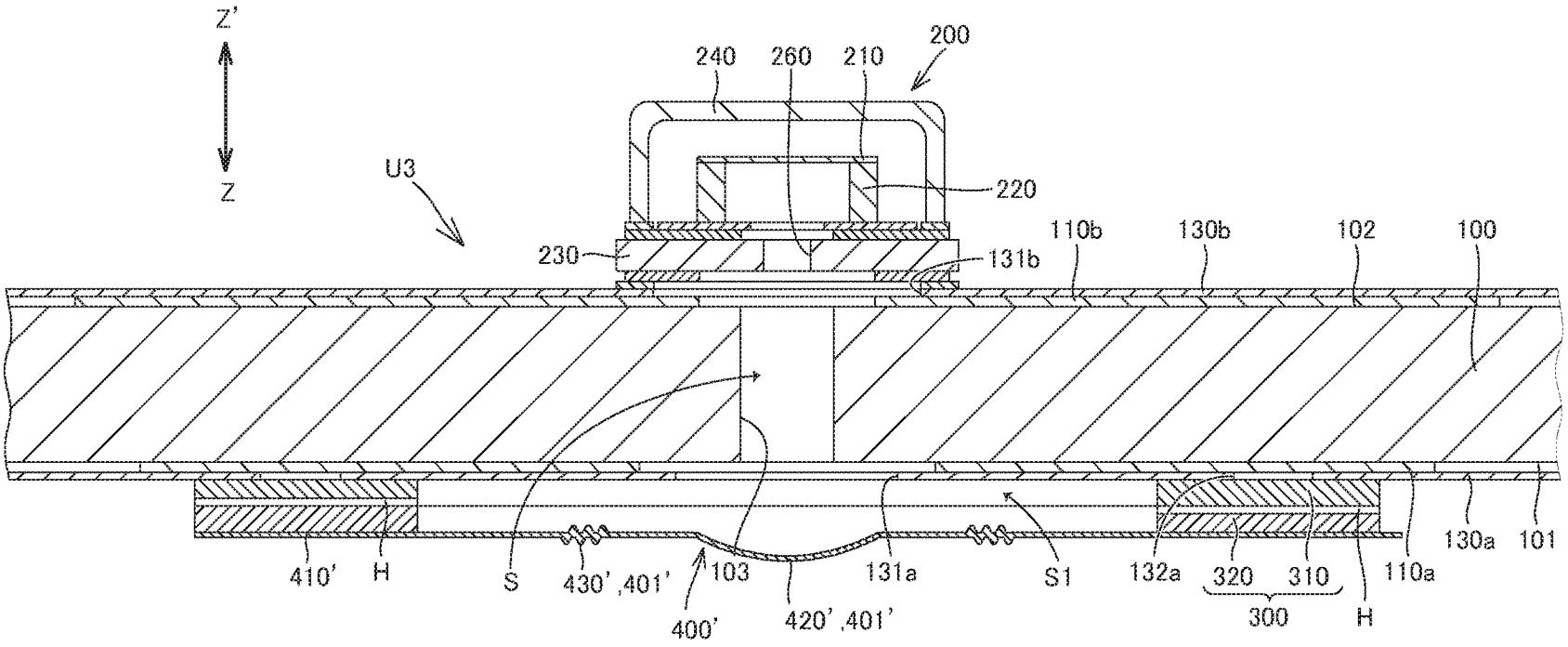
FIG. 6C is a schematic cross-sectional view of a second variant of the film of the microphone unit of the third embodiment.
Figure 6D:
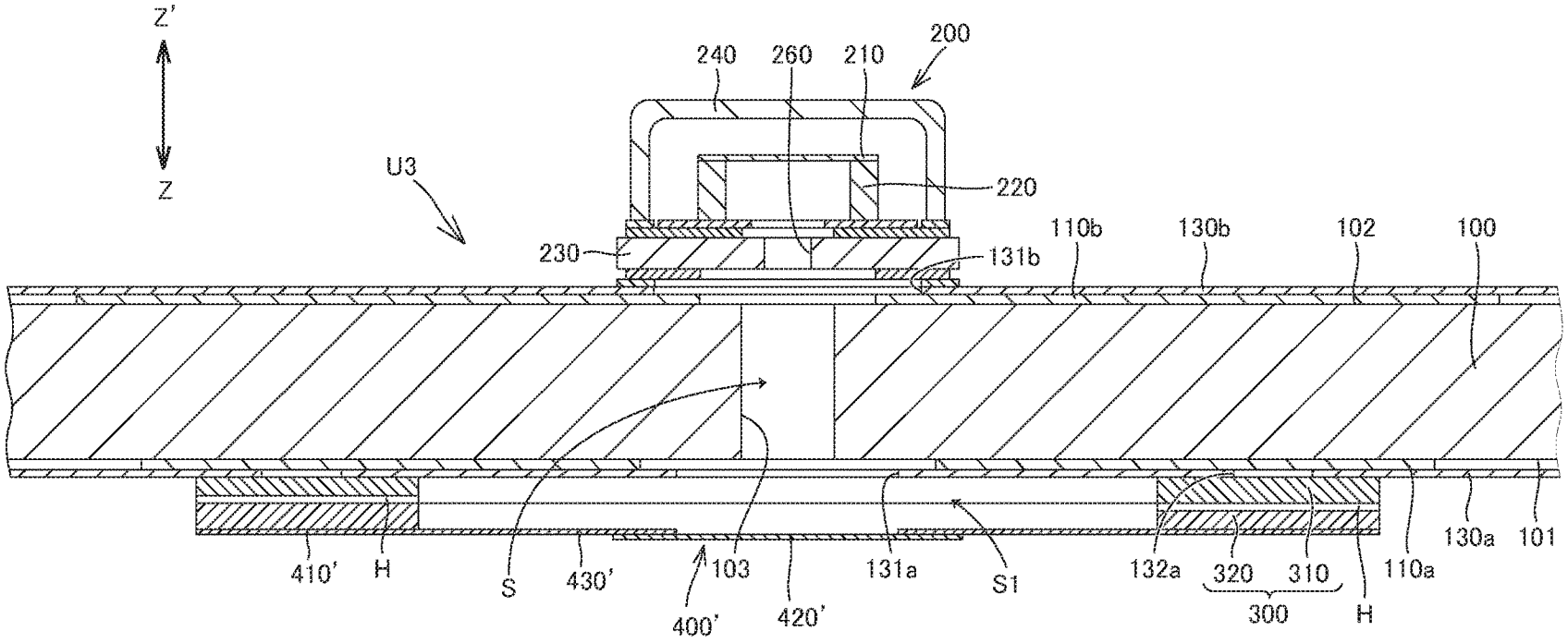
FIG. 6D is a schematic cross-sectional view of a third variant of the film of the microphone unit of the third embodiment.

At least one of the second portion 420' and the third portion 430' may have one of the following configurations a) to c):

a) At least one of the second portion 420' and the third portion 430' includes a slack portion 401'. The slack portion 401' may have a cross section of, for example, arc-shape, V-shape, U-shape, wavelike shape, or any other suitable shape. Some example configurations of the slack portion 401' are shown in FIGS. 6A to 6C. Particularly, as shown in FIG. 6A, the slack portion 401' may be provided in the second portion 420' and have a dome shape with a cross section of arc-shape. As shown in FIG. 6B, the slack portion 401' may be provided in the third portion 430' and have a corrugated shape with a cross section of wavelike shape. As shown in FIG. 6C, the slack portions 401' may be formed in each of the second portion 420' and the third portion 430'. In this case, the slack portion 401' of the second portion 420' may have a dome shape with a cross section of arc-shape, and the slack portion 401' of the third portion 430' may have a corrugated shape with a cross section of wavelike shape.

b) At least one of the second portion 420' and the third portion 430' is smaller in thickness (dimension in the Z-Z' direction) than the first portion 410'. The film 400' of configuration b) may particularly have one of the following configurations b-1) to b-4):

b-1) The first portion 410', the second portion 420' and the third portion 430' are formed integrally as a single film sheet, and at least one of the second portion 420' and the third portion 430' is smaller in thickness than the first portion 410'.

b-2) The first portion 410' is formed as a film sheet of loop shape, and the second portion 420' and the third portion 430' are formed integrally as another film sheet. In this case, the outer peripheral (outermost) portion of the third portion 430' may be fixed to the inner peripheral (innermost) portion of the first portion 410'. The film consisting of the second portion 420' and the third portion 430' is smaller in thickness than the film consisting of the first portion 410'.

b-3) The first portion 410' and the third portion 430' are formed integrally as a single film sheet of loop shape. The second portion 420' is formed as another film sheet. In this case, the peripheral (outermost) portion of the second portion 420' may be fixed to the inner peripheral (innermost) portion of the third portion 430'. The film consisting of the second portion 420' is smaller in thickness than the film consisting of the first portion 410' and the third portion 430'.

b-4) The first portion 410', the second portion 420', and the third portion 430' are respectively formed as a film sheet of loop shape, another film sheet, and still another film sheet of loop shape. The outer peripheral (outermost) portion of the third portion 430' may be fixed to the inner peripheral (innermost) portion of the first portion 410', and the inner peripheral (innermost) portion of the third portion 430' may be fixed to the peripheral (outermost) portion of the second portion 420'. At least one of the second portion 420' and the third portion 430' is smaller in thickness than the first portion 410'.

c) At least one of the second portion 420' and the third portion 430' is smaller in rigidity than the first portion 410'. The film 400' of configuration c) may particularly have one of the following configurations c-1) to c-3):

c-1) The first portion 410' is formed as a film sheet of loop shape, and the second portion 420' and the third portion 430' are formed integrally as another film sheet. In this case, the outer peripheral (outermost) portion of the third portion 430' may be fixed to the inner peripheral (innermost) portion of the first portion 410'. The film consisting of the second portion 420' and the third portion 430' is smaller in rigidity than the film consisting of the first portion 410'.

c-2) The first portion 410' and the third portion 430' are formed integrally as a single film sheet of loop shape, and the second portion 420' is formed as another film sheet (see FIG. 6D). In this case, the peripheral (outermost) portion of the second portion 420' may be fixed to the inner peripheral (innermost) portion of the third portion 430'. The film consisting of the second portion 420' is smaller in rigidity than the film consisting of the first portion 410' and the third portion 430'.

c-3) The first portion 410', the second portion 420', and the third portion 430' are respectively formed as a film sheet of loop shape, another film sheet, and still another film sheet of loop shape. The outer peripheral (outermost) portion of the third portion 430' may be fixed to the inner peripheral (innermost) portion of the first portion 410', and the inner peripheral (innermost) portion of the third portion 430' may be fixed to the peripheral (outermost) portion of the second portion 420'. At least one of the second portion 420' and the third portion 430' is smaller in rigidity than the first portion 410'.

Figure 6E:
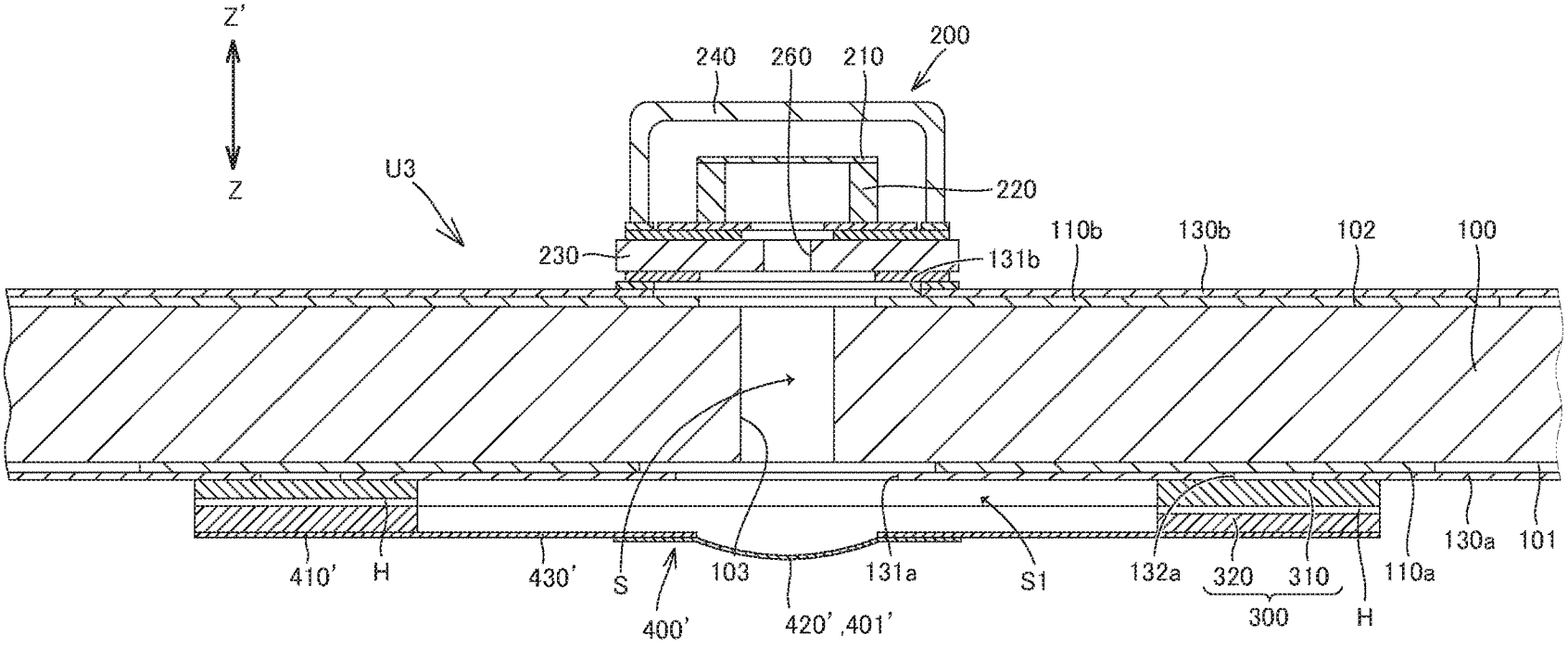
FIG. 6E is a schematic cross-sectional view of a fourth variant of the film of the microphone unit of the third embodiment.
Figure 6F:
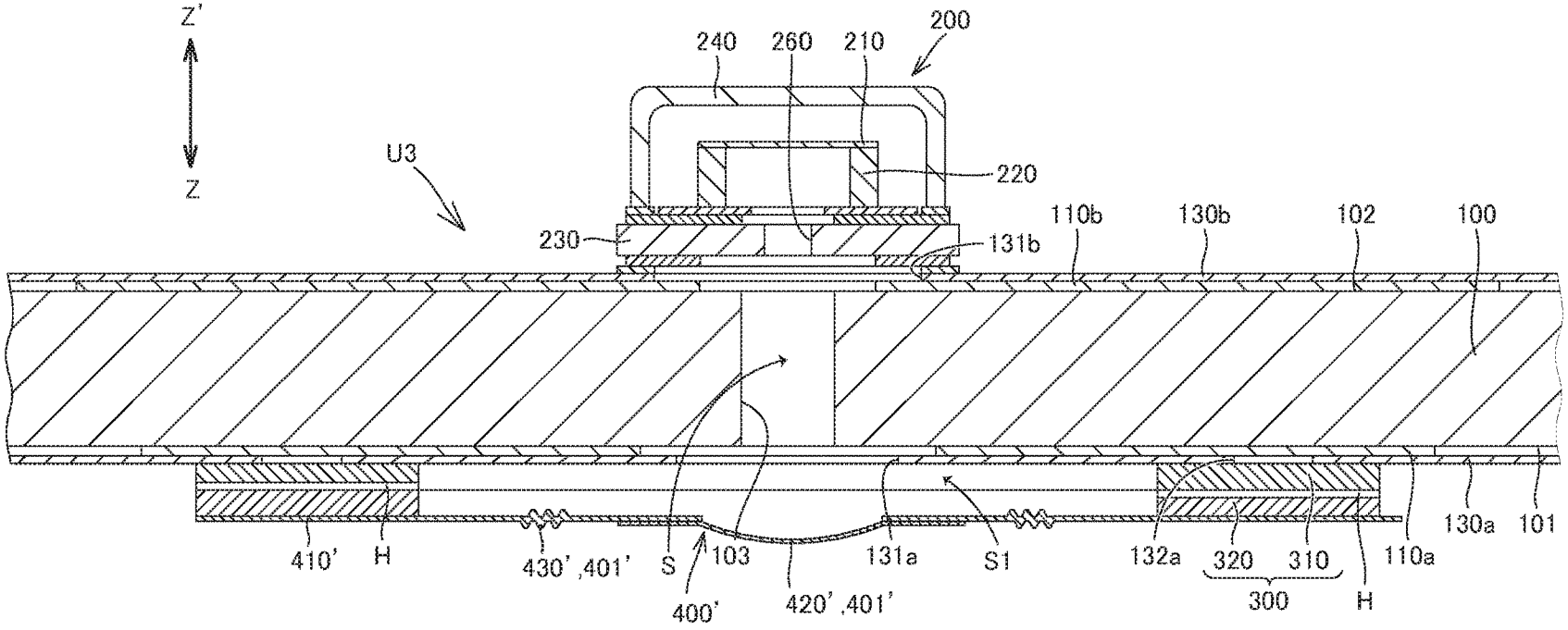
FIG. 6F is a schematic cross-sectional view of a fifth variant of the film of the microphone unit of the third embodiment.

The second portion 420' may have any suitable combination of the above configurations a) to c). An example combination is such that the first portion 410' and the third portion 430' are formed as a single film sheet of loop shape, the second portion 420' is formed as another film sheet, and the peripheral (outermost) portion of the second portion 420' is fixed to the inner peripheral (innermost) portion of the third portion 430'. In this case, as shown in FIG. 6E, the second portion 420' may have the slack portion 401' having a dome shape with a cross section of arc-shape, and the second portion 420' may be smaller in rigidity than the film consisting of the first portion 410' and the third portion 430'. Alternatively, as shown in FIG. 6F, the second portion 420' may have the slack portion 401' having a dome shape with a cross section of arc-shape, the third portion 430' may have the slack portion 401' having a cross section of wavelike shape, and the second portion 420' may be smaller in rigidity than the film consisting of the first portion 410' and the third portion 430'. The third portion 430' may also have any suitable combination of the above configurations a) to c). An example combination is such that the third portion 430' includes the slack portion 401' having a cross section of V-shape, U-shape, or wavelike shape, and that the third portion 430' is smaller in rigidity than the first portion 410' and the second portion 420'.

The unit U3 may be provided with at least one vent H, which or each of which is provided in the fixing member 300 or 300' or the substrate 100. Alternatively, the unit U3 may be provided without any vents H.

The unit U3, including the film 400' that is different from the film 400 as described above, can be manufactured in a similar manner as the unit U1 or the unit U2.

The above unit U3 provides similar technical features and effects as the those of the unit U1. The unit U3 further provides a third technical feature and effect as follows. In the unit U1 or U2, when the internal pressure of the enclosed space S becomes higher than the atmospheric pressure of the external environment to cause increased air resistance in the enclosed space S, which may in turn cause attenuation of sound signals in the enclosed space S. This may result in attenuation of the sound pressure levels of the sound signals in the enclosed space S to be applied onto the diaphragm 210 of the microphone 200. However, the increase of the internal pressure and the air resistance in the enclosed space S is alleviated if the unit U1 or U2 is provided with the at least one vent H. On the other hand, the unit U3 includes the film 400', particularly at least one of the second portion 420' and the third portion 430', configured as described above. As such, the film 400 can warp in the Z-Z' direction in response to changes in internal pressure of the enclosed space S, suppressing increase of the internal pressure and the air resistance in the enclosed space S. This reduces the possibility of sound signal attenuation due to the air resistance in the enclosed space S, and thereby reduces attenuation of the sound pressure levels of the sound signals in the enclosed space S to be applied onto the diaphragm 210 of the microphone 200. It is possible to further suppress increase of the internal pressure and the air resistance in the enclosed space S if the unit U3 is provided with the at least one vent H.

The above-described microphone units are not limited to the embodiments and their variants described above but may be modified in any manner within the scope of the claims. Some modification examples will be described below.

The microphone of the invention may be any kind of microphone with at least one sound hole. Particularly, the microphone of the invention is required to be a capacitor microphone but may be, for example, a dynamic microphone having at least one sound hole.

The film of the invention is only required to provide at least one of dustproofness and waterproofness. In other words, the film of the invention may not provide air impermeability (i.e., the film may have holes that allow airflow therethrough). The film of the invention may not provide heat resistance.

When used herein, the term "generally loop shape" means various shapes including a circular loop/ring shape, a polygonal loop/ring shape, a circular loop/ring shape with a cut-away portion, and a polygonal loop/ring shape with a cut-away portion. Accordingly, the fixing member and the electrode on the first face of the substrate of any aspect described above may each have a circular loop shape, a polygonal loop shape, a circular loop shape with a cut-away portion, and a polygonal loop shape with a cut-away portion. Also, the fixing member of any aspect described above may be provided as a plurality of fixing members. In this case, the fixing members may be fixed at spaced intervals (e.g., in a generally loop-shaped arrangement) on the first face of the substrate to be arranged around the through-hole. The electrode on the first face of the substrate may also be provided as a plurality of electrodes.

The first face of the substrate of the invention may be the outermost face in the Z direction of the substrate, and the second face of the substrate may be the outermost face in the Z' direction of the substrate.

It should be appreciated that the above embodiments and variants of the microphone units are described above by way of examples only. The materials, shapes, dimensions, numbers, arrangements, and other configurations of the constituents of the microphone units may be modified in any manner if they can perform similar functions. The configurations of the embodiments and the variants described above may be combined in any possible manner. The Z-Z' direction of the invention may be any direction as long as it is the thickness direction of the substrate of the invention. The planar direction of the invention may be any direction extending along the first face of the substrate of the invention.

Reference Signs List

- U1 to U3: microphone unit
  - 100: substrate
    - 101: first face
      - 110a: electrode (first electrode)
    - 102: second face
      - 110b: electrode (second electrode)
    - 103: through-hole
      - 130a: resist layer
      - 131a: opening
      - 132a: opening
      - 133a: outer peripheral portion
      - 134a: inner peripheral portion
    - 130b: resist layer
      - 131b: opening
      - 132b: opening
  - 200: microphone
    - 210: diaphragm
    - 220: frame
    - 230: substrate
    - 240: capsule
    - 250: IC
    - 260: sound hole
  - 300, 300': fixing member
    - 310: metal plate
    - 320, 320': adhesive portion
    - H: vent
  - 400, 400': film
    - 410, 410': first portion
    - 420, 420': second portion
    - 430, 430': third portion
    - 401': slack portion
- S: enclosed space
- S1: space (inside of fixing member)

The invention claimed is:

1. A microphone unit comprising:

a first substrate, including a first face, a second face opposite to the first face, and a through-hole extending from the first face to the second face through the first first substrate;

a microphone mounted on or fixed onto the second face of the first substrate, the microphone having a sound hole in communication with the through-hole of the first substrate;

a fixing member fixed onto the first face of the first substrate such as to be located around the through-hole; and a film providing at least one of dustproofness and waterproofness, wherein each of the fixing member and the film has an outer size of a cross-section in a planer direction that is smaller than that of the first substrate, the planer direction extending along the first face of the first substrate, and the film is fixed onto the fixing member such as to cover the through-hole.

2. The microphone unit according to claim 1, wherein the fixing member is generally loop-shaped and has an inner size that is larger than a size of the through-hole, and at least one of the fixing member and the first substrate is provided with a vent to connect an inside of the fixing member to an outside of the fixing member.

3. The microphone unit according to claim 2, wherein the film comprises:

a first portion fixed to the fixing member, a second portion located inside the first portion, and a third portion located between the first portion and the second portion, and at least one of the second portion and the third portion includes a slack portion.

4. The microphone unit according to claim 2, wherein the film comprises:

a first portion fixed to the fixing member, a second portion located inside the first portion, and a third portion located between the first portion and the second portion, and at least one of the second portion and the third portion is smaller in thickness than the first portion.

5. The microphone unit according to claim 2, wherein the film comprises:

a first portion fixed to the fixing member, a second portion located inside the first portion, and a third portion located between the first portion and the second portion, and at least one of the second portion and the third portion is smaller in rigidity than the first portion.

6. The microphone unit according to claim 2, wherein the first substrate further includes a first electrode on the first face, the fixing member includes a metal plate fixed to the film and bonded to the first electrode of the first substrate with a bonding material, and the vent is provided in at least one of the first electrode and the metal plate.

7. The microphone unit according to claim 2, wherein the fixing member comprises an adhesive portion to bond the film to the first substrate, and the vent is provided in the adhesive portion.

8. The microphone unit according to claim 2, wherein the vent extends through the fixing member and along the planer direction of the first substrate.

9. The microphone unit according to claim 1, wherein
the first substrate further includes a first electrode on the first face, and
the fixing member includes a metal plate fixed to the film and bonded to the first electrode of the first substrate with a bonding material.

10. The microphone unit according to claim 9, wherein the film further provides heat resistance.

11. The microphone unit according to claim 9, wherein the bonding material is solder or silver paste.

12. The microphone unit according to claim 1, wherein the fixing member comprises an adhesive portion to bond the film to the first substrate.

13. The microphone unit according to claim 1, wherein
the film comprises:
a first portion fixed to the fixing member,
a second portion located inside the first portion, and
a third portion located between the first portion and the second portion, and
at least one of the second portion and the third portion includes a slack portion.

14. The microphone unit according to claim 1, wherein
the film comprises:
a first portion fixed to the fixing member,
a second portion located inside the first portion, and
a third portion located between the first portion and the second portion, and
at least one of the second portion and the third portion is smaller in thickness than the first portion.

15. The microphone unit according to claim 1, wherein
the film comprises:
a first portion fixed to the fixing member,
a second portion located inside the first portion, and
a third portion located between the first portion and the second portion, and
at least one of the second portion and the third portion is smaller in rigidity than the first portion.

16. The microphone unit according to claim 1, wherein
the first substrate further includes second electrodes on the second face, and
the microphone is connected to the second electrodes.

17. The microphone unit according to claim 16, wherein
the substrate further includes a resist layer, and
the resist layer is located on the second face of the substrate and between the second face of the substrate and the microphone and includes:
a first opening in communication with the through-hole of the substrate and with the sound hole of the microphone, and
second openings, the second electrodes being exposed through the second openings.

18. The microphone unit according to claim 1, wherein the film further provides heat resistance.

19. The microphone unit according to claim 1, wherein
the microphone includes a capsule, a diaphragm inside the capsule, a fixed electrode inside the capsule with a space between the diaphragm and the fixed electrode, a second substrate fixed to the capsule or housed in the capsule,
the capsule or the second substrate has a sound hole, and
the outer size of the cross-section in the planer direction of each of the fixing member and the film is smaller than that of the second substrate.

20. A microphone unit comprising:
a substrate, including
a first face,
a second face opposite to the first face, and
a through-hole extending from the first face to the second face through the substrate:
a microphone mounted on or fixed onto the second face of the substrate, the microphone having a sound hole in communication with the through-hole of the substrate;
a fixing member being generally loop-shaped, having an inner size that is larger than a size of the through-hole, and fixed onto the first face of the substrate such as to be located around the through-hole; and
a film providing at least one of dustproofness and waterproofness, the film being fixed onto the fixing member such as to cover the through-hole, wherein
at least one of the fixing member and the substrate is provided with a vent to connect an inside of the fixing member to an outside of the fixing member, wherein
the substrate further includes at least one resist layer,
the at least one resist layer is located at least one of locations (1) and (2):
(1) on the first face of the substrate and between the first face of the substrate and the fixing member, and
(2) on the second face of the substrate and between the second face of the substrate and the microphone, and
the vent is provided in the resist layer.

21. A microphone unit comprising:
a substrate, including
a first face,
a second face opposite to the first face,
a through-hole extending from the first face to the second face through the substrate, and
a first electrode on the first face;
a microphone mounted on or fixed onto the second face of the substrate, the microphone having a sound hole in communication with the through-hole of the substrate:
a fixing member fixed onto the first face of the substrate such as to be located around the through-hole, the fixing member including a metal plate fixed to the film and bonded to the first electrode of the substrate with a bonding material; and
a film providing at least one of dustproofness and waterproofness, the film being fixed onto the fixing member such as to cover the through-hole, wherein
the substrate further includes a resist layer,
the resist layer is located on the first face of the substrate and between the first face of the substrate and the fixing member and includes:
a first opening in communication with the through-hole of the substrate,
a second opening located around the first opening, the first electrode being exposed through the second opening,
an outer peripheral portion surrounding the second opening, and
an inner peripheral portion surrounded by the second opening, and
at least one of the outer peripheral portion and the inner peripheral portion is held by and between the fixing member and the first face of the substrate.

* * * * *